US009157611B2

(12) United States Patent
Kim et al.

(10) Patent No.: US 9,157,611 B2
(45) Date of Patent: Oct. 13, 2015

(54) LIGHTING APPARATUS HAVING A STRUCTURE FOR MOUNTING THE LIGHTING ARRARATUS

(71) Applicants: Jongpil Kim, Seoul (KR); Samje Cho, Seoul (KR); Ana Kim, Seoul (KR)

(72) Inventors: Jongpil Kim, Seoul (KR); Samje Cho, Seoul (KR); Ana Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 391 days.

(21) Appl. No.: 13/672,025

(22) Filed: Nov. 8, 2012

(65) Prior Publication Data

US 2013/0258660 A1 Oct. 3, 2013

(30) Foreign Application Priority Data

Apr. 2, 2012 (KR) ..... 10-2012-0033860

(51) Int. Cl.

| | |
|---|---|
| ***F21V 21/00*** | (2006.01) |
| ***F21V 21/03*** | (2006.01) |
| *F21S 8/00* | (2006.01) |
| *F21S 8/04* | (2006.01) |
| *F21Y 101/02* | (2006.01) |
| *F21Y 105/00* | (2006.01) |

(52) U.S. Cl.

CPC ..... *F21V 21/00* (2013.01); *F21V 21/03* (2013.01); *F21S 8/033* (2013.01); *F21S 8/04* (2013.01); *F21Y 2101/02* (2013.01); *F21Y 2105/001* (2013.01)

(58) Field of Classification Search

CPC ..... F21V 21/042; F21V 21/049; F21V 21/00; F21V 21/03

USPC ..... 362/368, 371, 147, 249.11

See application file for complete search history.

(56) References Cited

U.S. PATENT DOCUMENTS

| | | | | |
|---|---|---|---|---|
| 4,976,633 | A * | 12/1990 | Beghelli | 439/571 |
| 7,988,321 | B2 | 8/2011 | Wung et al. | |
| 2012/0069557 | A1* | 3/2012 | Bolscher | 362/217.16 |
| 2013/0128558 | A1* | 5/2013 | Risley et al. | 362/147 |

FOREIGN PATENT DOCUMENTS

| | | | |
|---|---|---|---|
| JP | 2011-198618 | | 10/2011 |
| KR | 10-2005-0107862 | A | 11/2005 |
| KR | 10-2010-0019269 | A | 2/2010 |
| KR | 10-2010-0108743 | A | 10/2010 |

* cited by examiner

*Primary Examiner* — Karabi Guharay

(74) *Attorney, Agent, or Firm* — Ked & Associates, LLP

(57) ABSTRACT

Provided is a lighting apparatus including a housing, a plurality of LEDs provided in the housing, a diffuser provided at the housing and positioned over the plurality of LEDs, a mounting bracket having a first hanger arranged to face a first direction and a second hanger arranged to face a second direction, and a first connector and a second connector provided at a rear surface of the housing and positioned to correspond to the first and second hangers of the mounting bracket. The first and second connectors may include a catch for mating with the first and second hangers, and the catch of the first connector is configured to be adjustable to mate with the first hanger.

19 Claims, 10 Drawing Sheets

LIGHTING APPARATUS HAVING A STRUCTURE FOR MOUNTING THE LIGHTING ARRARATUS

CROSS-REFERENCE TO RELATED APPLICATION(S)

This application claims priority under 35 U.S.C. §119 to Korean Application No. 10-2012-0033860 filed on Apr. 2, 2012, whose entire disclosure(s) is/are hereby incorporated by reference.

BACKGROUND

1. Field

A lighting apparatus including a structure for mounting the lighting apparatus is disclosed herein.

2. Background

Lighting apparatuses that include structures for mounting the lighting apparatuses are known. However, they suffer from various disadvantages.

BRIEF DESCRIPTION OF THE DRAWINGS

The embodiments will be described in detail with reference to the following drawings in which like reference numerals refer to like elements, wherein.

DETAILED DESCRIPTION

Figure 1:
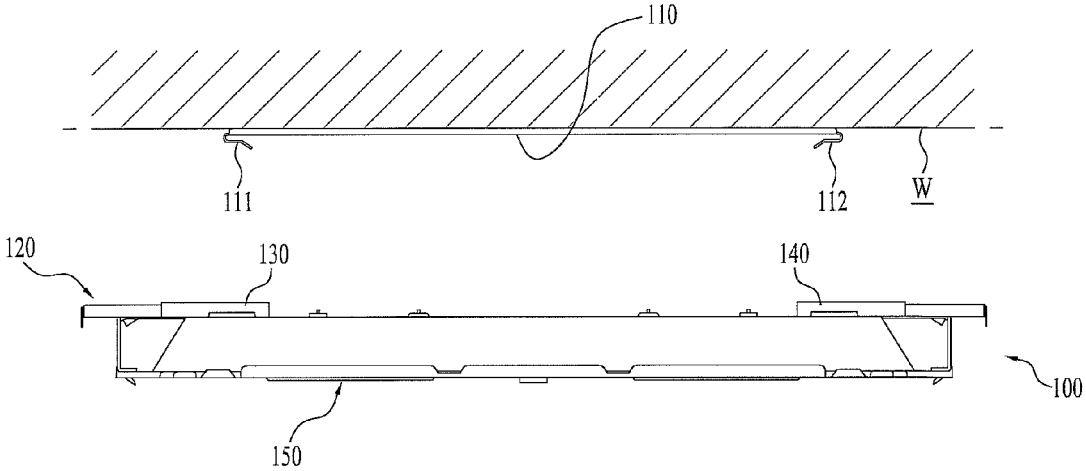
FIG. 1 is a side view of a lighting apparatus according to an embodiment as broadly described herein.

A lighting apparatus according to embodiments of the present disclosure will be described in detail with reference to the accompanying drawings as follows. The accompanying drawings illustrate various examples of the present disclosure and they are provided to facilitate description of embodiments of the present disclosure, however, the present disclosure is not limited thereto.

Reference will now be made in detail to the specific embodiments of the present disclosure, examples of which are illustrated in the accompanying drawings. Wherever possible, the same reference numbers will be used throughout the drawings to refer to the same or like parts. Repeated description will be omitted and the size and appearance of each component, illustrated to facilitate explanation and for convenience, may not be to scale.

Meanwhile, terminology including ordinal numbers such as 'first' and 'second' may be used to explain various parts of the present disclosure and the various parts are not limited by the terminology. The terminology is used only to distinguish one of the parts from the others.

Generally, a light emitting diode (hereinafter, LED) is a semiconductor element which is luminescent when a forward voltage is applied thereto. Such a light emitting diode may have a relatively longer life span and lower power consumption when compared to other types of light sources. In addition, the LED may have electrical, optical and physical characteristics which are suitable for mass production.

LED lighting systems have been used in to large buildings to illuminate rooms. LED lighting systems may be installed on the ceiling of a room at predetermined intervals. Meanwhile, a LED lighting apparatus for lighting a large space such as found an office may typically be a flat illumination type installed and fixed to a ceiling.

Such a flat illumination type LED lighting apparatus may include a flat housing that defines an exterior appearance thereof, a LED light source arranged in the housing and an electric control part (for example, a converter) to supply electric power to the LED light source. The electric control part may be coupled to an outer portion of the housing while a plurality of LED may be arranged inside the housing.

In addition, the LED lighting apparatus may have a structure that enables a housing to be directly installed to the ceiling using a screw. In this structure, an area occupied by a substrate provided in the LED lighting apparatus may result in decreasing as much an area occupied by the screw. Accordingly, the LED lighting apparatus may not have an ideal footprint nor efficient utilization of space.

To lower the LED lighting apparatus from the ceiling, the screw can only be removed after a front case or cover of the housing is first removed. Moreover, to install the LED lighting apparatus to the ceiling, the front case can be assembled to a rear case only after the rear case of the housing is first fixed to the ceiling. As a result, there is a demand for a structure that enables an LED lighting apparatus to be installed and removed from a wall easily.

Figure 2:
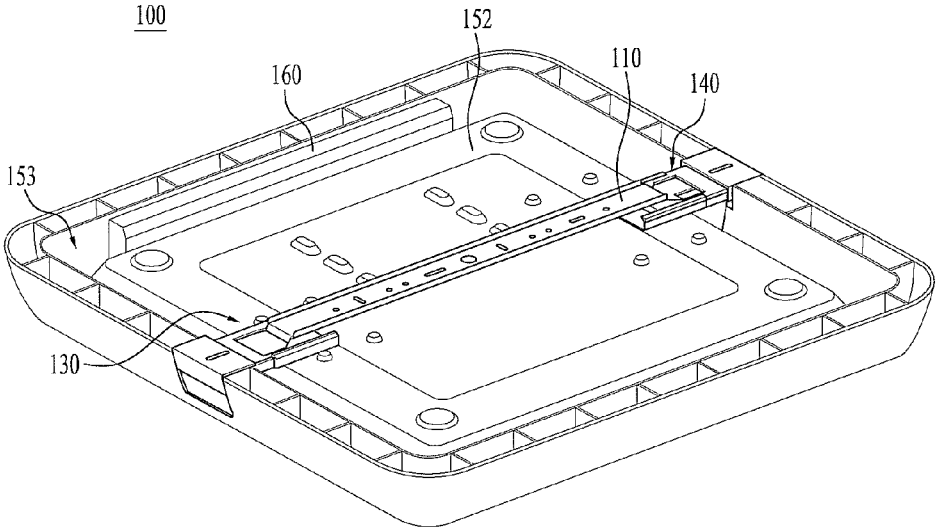
FIG. 2 is a rear perspective view of a lighting apparatus according to the embodiment as broadly described herein.
Figure 3:
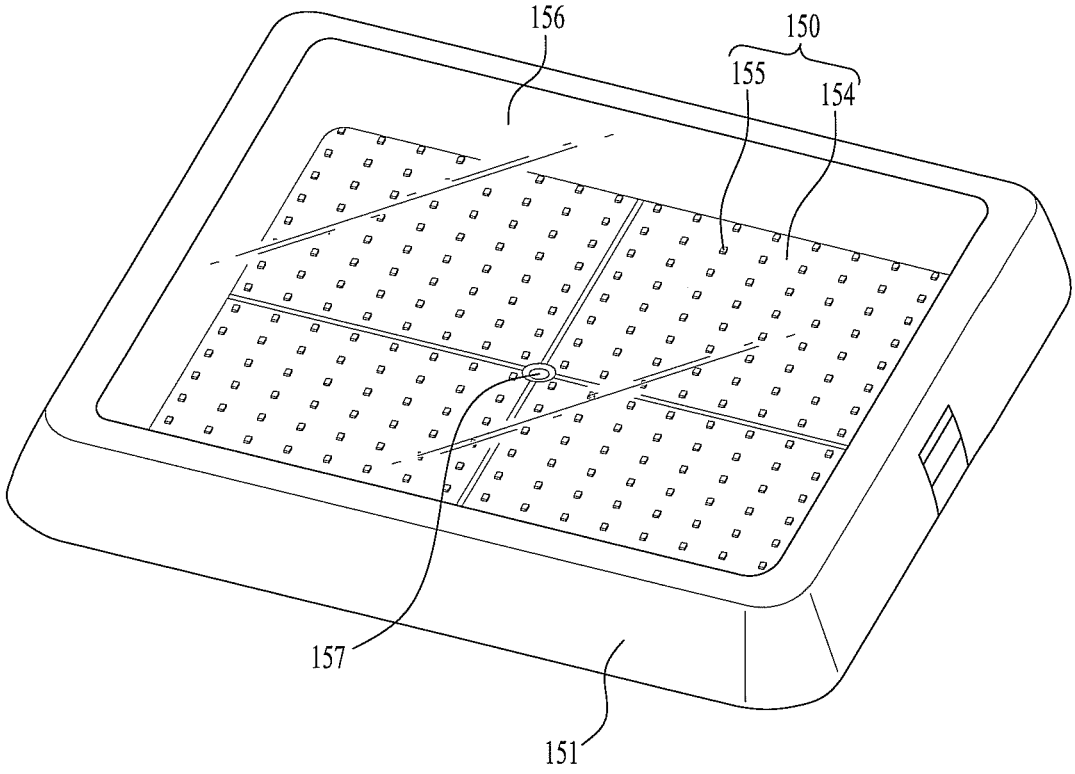
FIG. 3 is a front perspective view of a lighting apparatus according to the embodiment as broadly described herein.

FIG. 1 is a side view of a lighting apparatus, FIG. 2 is a rear perspective view of the lighting apparatus, and FIG. 3 is a front perspective view of the lighting apparatus according to an embodiment as broadly described herein. The lighting apparatus may include a bracket 110 (also, coupling bracket) configured to be fixed to a wall (W) such as a ceiling, a light emitting device 150 and a connector assembly 120 (also, coupling module) configured to selectively couple the light emitting device 150 to the bracket 110.

Specifically, the lighting apparatus 100 may include the bracket 100 having first and second hanging devices 111 and 112 spaced apart a predetermined distance from each other; the connector assembly 120 having first and second connectors 130 and 140 (also, coupling devices) to selectively couple to the first and second handing devices 111 and 112, respectively; and the light emitting device 150 that includes a housing 151 and 152 to which the connector assembly 120 is fixed and at least one LED 155 arranged in the housing 151 and 152.

In this instance, the connector assembly 120 may be configured such that a distance between the first and second connectors 130 and 140 may be adjusted based on the distance between the first and second hanging devices 111 and 112.

The bracket 110 may have a bar-shape, with a predetermined length, and may be formed of a material, such as, for example, metal to enhance durability and rigidity. Also, the bracket 110 may be fixed to the wall (W) via fastening means such as screws.

Also, the first hanging device 111 and the second hanging device 112 may be provided in both longitudinal ends of the bracket 100, respectively. The hanging device 111, 112 may be hangers, hooks or another appropriate type of structure for hanging the light emitting device 150 via corresponding connectors 130, 140. Moreover, the hanging devices 111, 112 may have a plurality of different shapes appropriate for coupling to the connectors 130, 140. Simply to facilitate description, the hanging devices 111, 112 are referred to hereinafter as hangers.

The distance between the first hanger 111 and the second hanger 112 may be determined based on the installation space and the size and weight of the light emitting device 150. According to an embodiment, the first and second hangers 111 and 112 may be formed to extend inwardly from the longitudinal ends of the bracket 110, respectively, and they may have a substantially C-shaped cross-section or another appropriate type of shape.

The housing 151 may be a front case and the housing 152 may be a rear case for the light emitting device 150. At least one substrate 154 may be mounted to the rear case 152 and the plurality of the LED 155 may be mounted on the substrate. However, it should be appreciated that the present disclosure is not limited to mounting a light emitting device 150 as illustrated, but may be applicable to other types of lighting devices as well as any appropriate type of device which can be mounted, for example, mobile terminals such as portable display devices or mobile phones.

The front case 151 and the rear case 152 may compose the housing mentioned above. The housing 151 and 152 may further include a diffuser 156 mounted to the front case 151 to form a luminous surface. Also, the diffuser 156 may be detachably mounted to the front case 151.

FIG. 3 shows four substrates 154 arranged to be co-planar and adjacent to each other. However, the number, size and position of the substrates 154 may be freely determined based on the requirements of the lighting space.

In addition, a through-hole 157 may be provided in the rear case 152 and a cable used for electrically connecting an electric control device 160 to the substrate 154 may be routed via the through-hole 157. The electric control device 160 may supply electric power to the LED 155 via the substrate 154. In this instance, a recess 153 may be provided at the rear surface of the housing 152 and the electric control device 160 which is electrically connected with the LED 155 may be arranged in the recess 153. Accordingly, when the lighting apparatus 100 is installed on the wall in a separate space for arranging the electric control device 160 (e.g., a recess formed in the wall or auxiliary space formed in the housing) need not be provided.

Figure 4A:
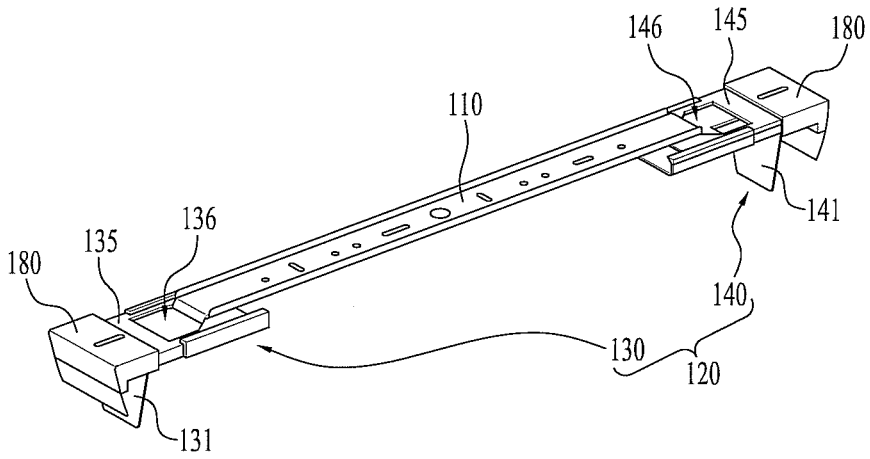
FIG. 4A is a perspective view and FIG. 4B is an exploded perspective view of a bracket and a connector assembly that are provided in the lighting apparatus according to the embodiment as broadly described herein.
Figure 4B:
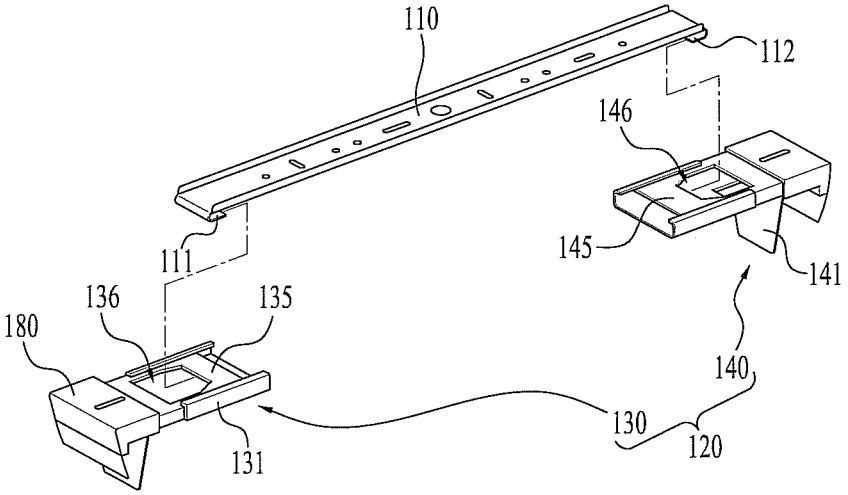

FIG. 4 is a perspective view of the bracket and the connector assembly which are provided in the lighting apparatus according to an embodiment of the disclosure. In reference to FIGS. 1 to 4, to mount or demount the lighting apparatus 100 to or from the bracket 110, the connector assembly 120 may have a structure which is capable of adjusting the distance between the first and second connectors 130 and 140, corresponding to the distance between the first and second hangers 111 and 112.

In other words, each of the first connector 130 and the second connector 140 may have a structure that can receive a corresponding one of the first and second hangers 111 and 112. The light emitting device 150 may be mounted to or demounted from the bracket 110 based on the distance between the first connector 130 and the second connector 140. To adjust the distance between the first connector 130 and the second connector 140, the first connector 130 may be movable toward the second connector 140, or the first connector 130 and the second connector 140 may both be moved toward each other.

The first connector 130 and the second connector 140 may include a catch (receiver) for receiving the first and second hangers 111, 112. For example, the catch may be formed by through-holes to receive corresponding ones of the first hanger 111 and the second hanger 112 therein, respectively. As the distance between the first connector 130 and the second connector 140 is adjusted, the first hanger 111 and the second hanger 112 may be inserted in the through-holes of the corresponding connectors 130 and 140, respectively.

According to an embodiment, when the first connector 130 and the second connector 140 are positioned at their initial or default positions, the first hanger 111 may be inserted in the corresponding through-holes formed in the first connectors 130. However, since the distance between the connectors 130, 140 is less than the distance between the hangers 111, 112, the second hanger 112 cannot be inserted in the corresponding through-hole formed in the second connector 140.

When the first and second connectors 130 and 140 are moved toward each other by a prescribed amount, both the first and second hangers 111 and 112 may be inserted in the corresponding through-holes of the first and second connectors 130 and 140, respectively. Thereafter, when the first and second connectors 130 and 140 are returned to their initial positions, the first and second hangers 111 and 112 may be locked in their respective positions in the through-holes 136, 146 of the first and second connectors 130 and 140, respectively, and the bracket 110 and the connector assembly 120 may be connected to each other.

The first and second connectors 130 and 140 may have the same structure. However, when only the first connector 130 is configured to be movable toward the second connector 140, the first and second connectors 130 and 140 may have different structures from each other. Simply for discussion purposes, the first connector 130 will be described in detail where the first and second connectors 130 and 140 have the same structure as follows.

Figure 5:
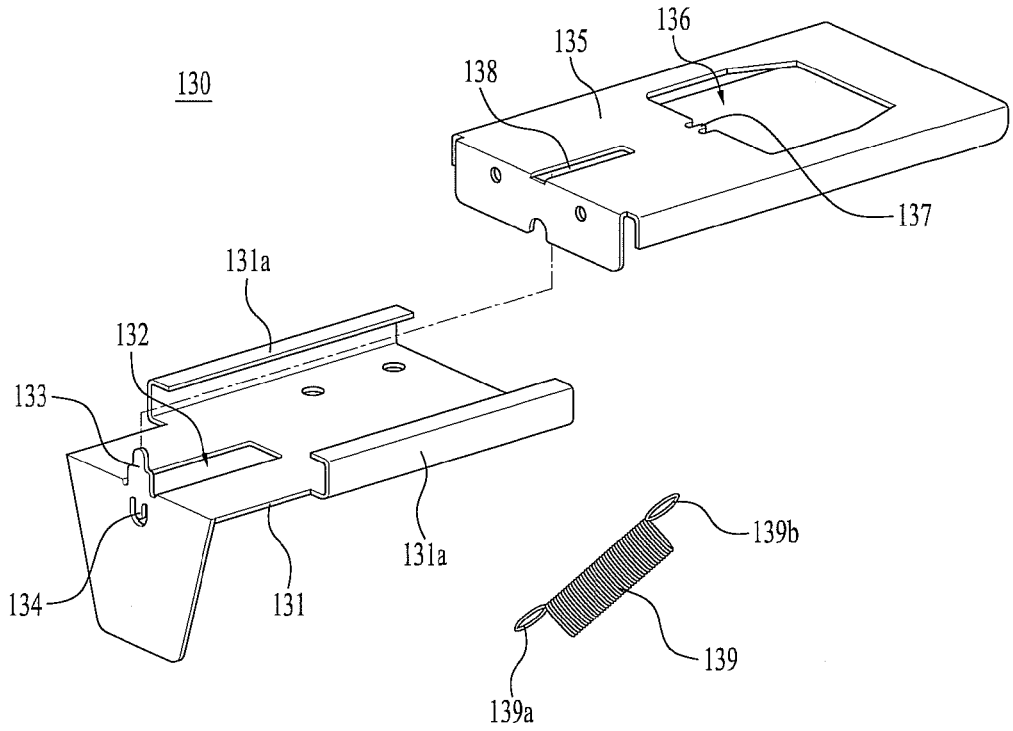
FIG. 5 is an exploded perspective view of the connector of FIG. 4.
Figure 6:
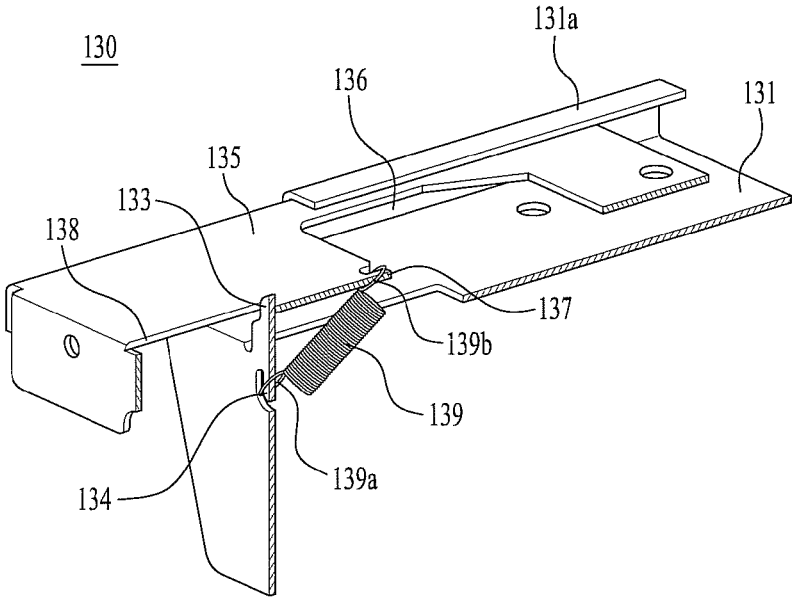
FIG. 6 is a cut-away perspective view illustrating a coupled state of component parts of the connector FIG. 5.

FIG. 5 is an exploded perspective view of the connector assembly provided in the lighting apparatus and FIG. 6 is a cut-away perspective view illustrating a connection of component elements of the connector of FIG. 5.

The first connector 130 may include a connector base 131 (guide member) fixed to the housing, a sliding member 135 (also, catch or slide) slidably coupled to the base 131 and having a through-hole 136 where the first hangers 111 may be inserted, and a spring 139 (also, elastic member) connected between the base 131 and the sliding member 135. The spring 139 may hold the base 131 and the sliding member 135 together by spring tension.

The base 131 may receive the sliding member 135. The base 131 may have a separation preventing device 131*a* that surrounds both lateral ends thereof to guide the sliding movement of the sliding member 135 while preventing separation of the sliding member 135 from the base 131. The separation preventing device 131*a* may be a C-channel or another appropriate structure that allows the slide member to be slidably connected. The base 131 may be coupled to a back surface of the rear case 152 of the housing.

In addition, a guide projection 133 that protrudes toward the sliding member 135 may be provided in the base 131 and a guide slot 138 may be provided in the sliding member 135 to guide the sliding movement of the guide projection 133. In this structure, the sliding member 135 may slide toward the second connector 140 along the C-channel 131*a* of the base 131 while the guide projection 133 is positioned in the guide slot 138. Moreover, the displacement variation of the sliding member 135 may be determined based on the length of the guide slot 138.

The spring 139 may have a tensile force along a direction that restores the sliding member 135 to the initial position. A first coupling projection 134 may be provided in the base 131 to couple a longitudinal end 139*a* of the spring 139 thereto and an opening 132 may be provided in the base 131 to allow a predetermined portion of the spring 139 to pass there through. A second coupling projection 137 may be provided in an inner circumferential surface of the through-hole 136 formed in the sliding member 135 to couple the other longitudinal end 139*a* of the spring 139.

When the sliding member 135 slides toward the second connector 140 from an initial position in this structure, the first hanger 111 may be inserted in the through-hole 136. When a position of the sliding member 135 is restored to the initial position by the force of the spring 139, the first hanger 111 may be coupled to the first connector 130. In this instance, the first hanger 111 may be positioned in the space formed between the base 131 and the sliding member 135 via the through-hole 136, in surface contact with an inner circumferential surface of the sliding member 135. The sliding members 135, 145 may also be referred to as a catch for the hangers 111, 112

Unless the sliding member 135 is again moved toward the second connector 140 after the sliding member 135 is positioned at the initial position by the spring 139, the first hanger 111 may not separate from the first connector 130.

Meanwhile, the structure of the second connector 140 may be identical to the structure of the first connector 130. Specifically, the second connector 140 may include a base 141 fixed to the housing, a sliding member 145 (e.g., catch) slidably coupled to the base 141 and having a through-hole 146 provided to receive the second hanger 112 therein, and a spring configured to connect the base 141 and the sliding member 145 to each other.

Also, the base 141 may have a separation preventing device 141*a* that surrounds both lateral ends thereof to guide the sliding movement of the sliding member 145 while preventing separation of the sliding member 145 from the base. The separation preventing device 141*a* may be a C-channel or another appropriate type of structure that slidably connects the slide member 145 to the base 141. In addition, a guide projection that protrudes toward the sliding member 145 may be provided in the base 141 and a guide slot may be provided in the sliding member 145 to guide the sliding movement of the guide projection.

In this structure, the sliding member 145 may slide toward the first connector 130 along the C-channel of the base 141 while the guide projection is positioned in the guide slot.

The spring of the second connector 140 may have a tensile force along a direction for restoring the sliding member 145 to it's initial or default position. A first coupling projection may be provided in the base 141 to couple a longitudinal end of the spring thereto and an opening may be provided in the base 141 to enable a predetermined portion of the spring to pass there through. A second coupling projection may be provided in an inner circumferential surface of the through-hole 146 formed in the sliding member 145 to couple the other longitudinal end of the spring.

When the sliding member 145 of the second connector 140 slides toward the first connector 130 from an initial position in this structure, the second hanger 112 may be inserted in the through-hole 146. When the sliding member 145 is repositioned to the initial position by the restitutive force of the spring, the second hanger 112 may be coupled to the second connector 140. In this instance, the second hanger 112 may be positioned in the space formed between the base 141 and the sliding member 145 via the through-hole 146, in surface contact with an inner circumferential surface of the sliding member 145.

Unless the sliding member 145 is again moved toward the first connector 130 after the sliding member 145 is repositioned at the initial position by the spring, the second hanger 112 may not be separated from the second connector 140.

Alternatively, the second connector 140 may have a variety of structure having a through-hole to insert the second hanger 112 therein. In this instance, the sliding member 135 of the first connector 130 may be configured to slide while coupling the second hanger 112 to the second connector 140. After that, the first hanger 111 may be coupled to the first connector 130 and the light emitting device 150 may be fixed to the bracket 110.

Figure 7:
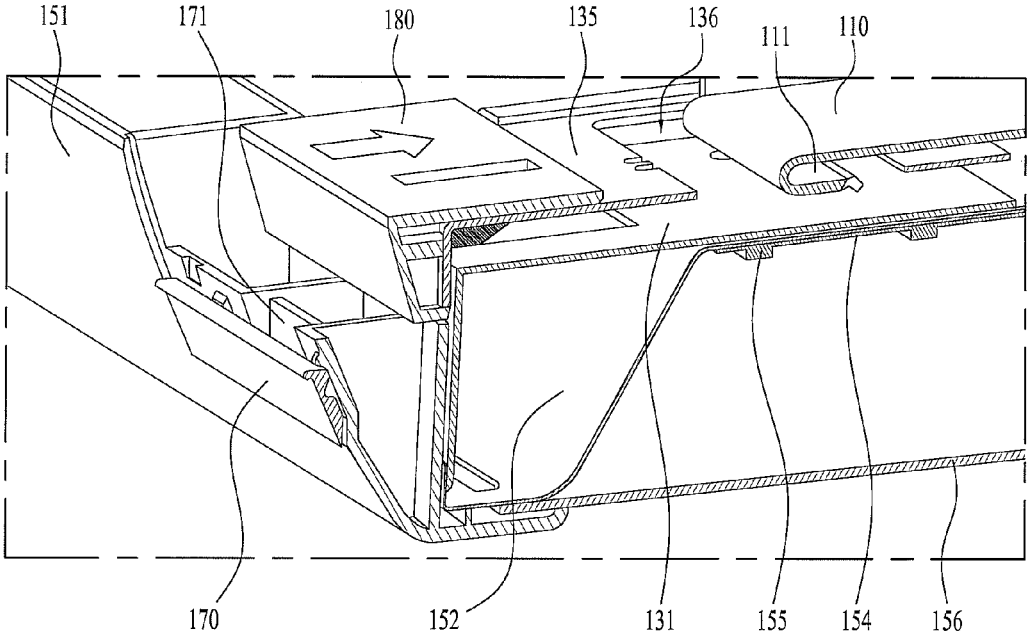
FIGS. 7 to 10 are diagrams illustrating an installation state of the lighting apparatus according to embodiments as broadly described herein.
Figure 8:
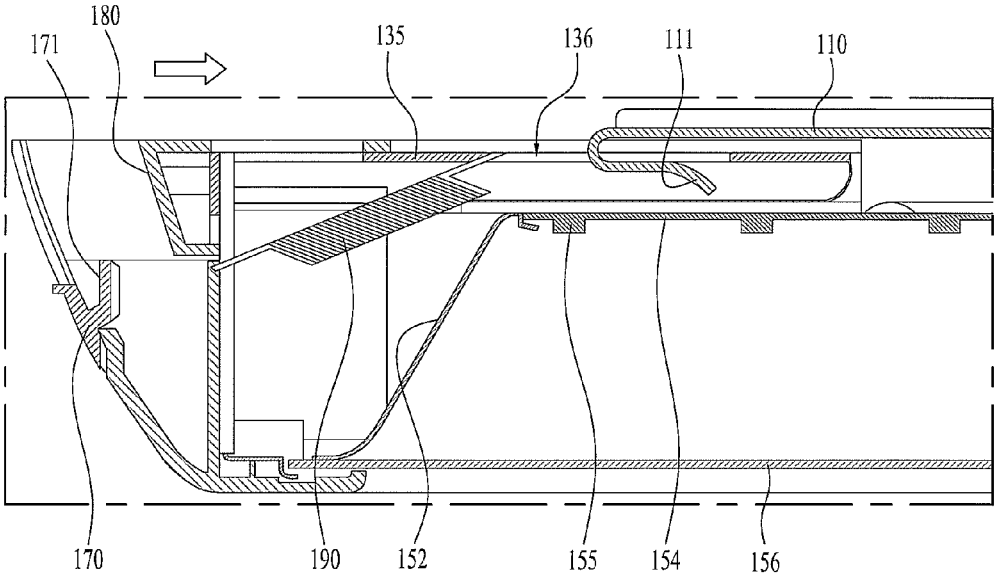
Figure 9:
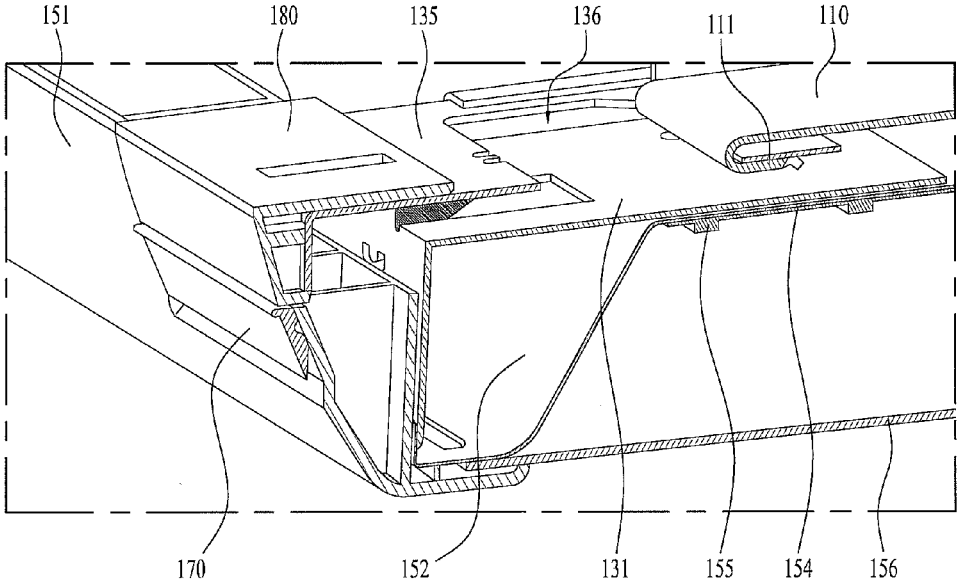
Figure 10:
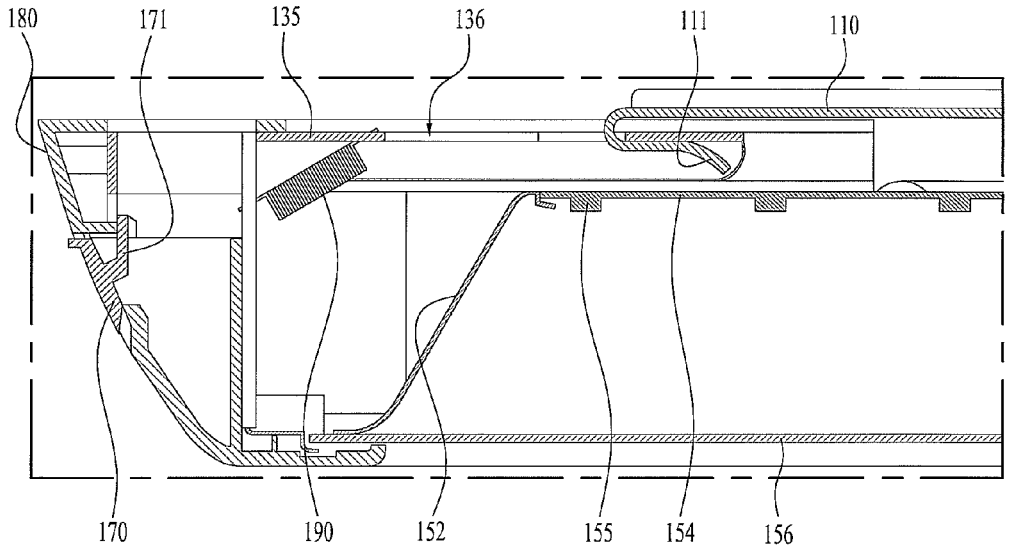

FIGS. 7 to 10 are diagrams that illustrate the installation state of the lighting apparatus according to embodiments of the disclosure as broadly described herein. FIGS. 7 and 8 are perspective and sectional views, respectively, illustrating a state of the sliding member 135 of the first connector 130 sliding toward the second connector 140. FIGS. 9 and 10 are perspective and sectional views, respectively, illustrating the initial or default position of the sliding member 135 provided in the connector 130.

In reference to FIGS. 7 and 8, a handle 180 may be provided in each of the connectors 130 and 140 to enable a user to press the sliding part 135 smoothly. The handle 180 may be a cover for the connectors 130, 140. To couple the light emitting device 150 to the bracket 110, the user may slide the sliding member 135 of the first connector 130 toward the second connector 140 by pressing the handle 180 of the first connector 130.

In this instance, the sliding member 135 may slide along the C-channel 131*a* of the base 131 as far as the length of the guide slot 138. In a state of the guide projection 133 is placed in the guide slot 138, the sliding member 135 may slide toward the second connector 140 from the initial position along the C-channel 131*a* of the base 131. In this state, the first hanger 111 of the bracket 110 may be inserted in the through-hole 136 of the first connector 130.

As the sliding member 135 is moved, the spring 139 may be stretched. The spring 139 may apply a tensile force along the direction capable of restoring the sliding member 135 to it's initial or resting position.

When the sliding member 135 is moved toward the second connector 140 in this structure, the first hanger 111 may be inserted in the through-hole 136. When a position of the sliding member 135 is restored to the initial position, the first hanger 111 may be coupled to the first connector 130.

In this instance, the first hanger 111 may be located in the space between the guide part 131 and the sliding member 135 and it may maintain the surface contact with the inner circumferential surface of the sliding member 135.

Also, unless the sliding member 135 is again slid toward the second connector 140 after the sliding member 135 is repositioned to the initial position by the spring 139, the first hanger 111 may not be separated from the first connector 130.

Meanwhile, when the user presses he handle 180 while the light emitting device 150 is installed on the bracket 110, the light emitting device 150 may be separated from the bracket 110. In this instance, the lighting apparatus 100 may further include a locking device 170 to lock the sliding member 135 at the initial or resting position thereby locking the lighting apparatus 100 in place (see FIGS. 9 and 10). The locking device 170 may be in contact with the sliding member 135 to prevent the sliding member 135 from sliding toward the second connector 140 from a first position (see FIGS. 9 and 10).

In more detail, the locking member 170 may be movably coupled to the housing, specifically, a front case or a rear case 151, 152 from the first position and the second position. The locking member 170 may include a stopper 171 configured to selectively contact the sliding member 135 to stop the sliding member 135 from sliding toward the second connector 140. When the handle 180 is coupled to the sliding member 135, the stopper 171 of the locking member 170 may selectively contact the stopper 171 of the locking member 170. Accordingly, the sliding member 135 is prevented from sliding in the first position at which the stopper 171 is in contact with the sliding member 135 such that the first hanger 111 may not be separated from the first connector 130.

In contrast, when the locking member 170 is moved to the second position (see FIGS. 7 and 8), the stopper 171 may be detached from the sliding member 135 and the sliding member 135 may be slidable. Accordingly, the locking member 170 may prevent the light emitting device 150 from being detached from the bracket 110.

Figure 11:
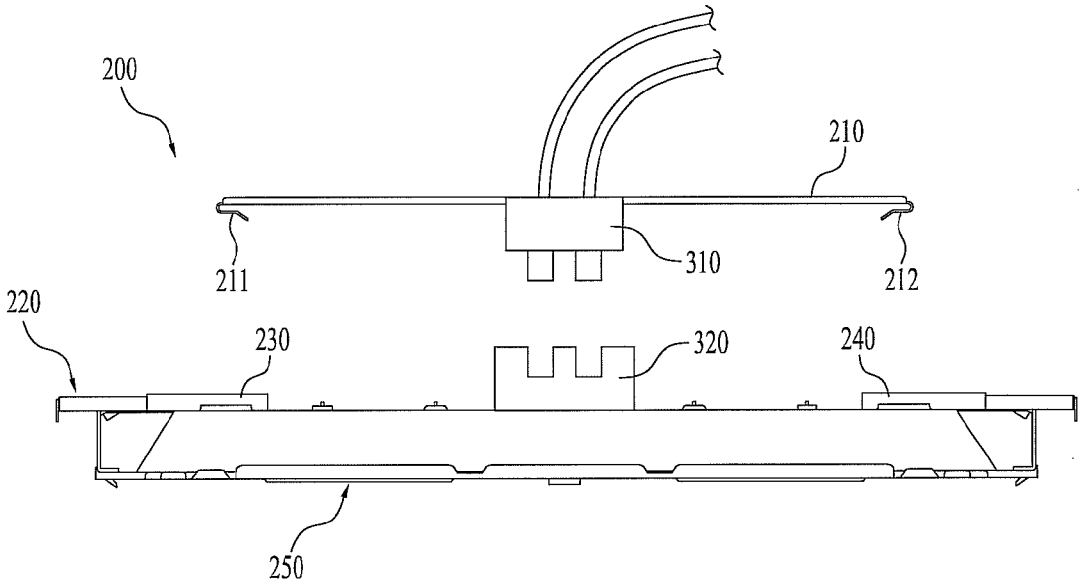
FIG. 11 is a side view of a lighting apparatus according to embodiment of the disclosure as broadly described herein.

FIG. 11 is a side view of a lighting apparatus according to one embodiment of the disclosure. A lighting apparatus 200 may include a bracket 210 having a first terminal 310 and first and second hanging devices 211, 212 (e.g., hangers, hooks, etc.) spaced apart a predetermined distance from each other; a connector assembly 220 (also, coupling module) having first and second connectors 230, 240 (also, coupling devices) to selectively couple the hanging devices 211, 212 thereto, respectively; and a light emitting device 250. The light emitting device 250 may include a housing to couple the connector assembly 220 thereto, and having a light emitting surface and a back surface wherein an LED light source may be arranged in the housing and a second terminal 320 is provided for connection with the first terminal 310.

In this instance, the connector assembly 220 may adjust a distance between the first and second connectors 230 and 240 according to the distance between the first and second hangers 211 and 212.

The first and second connectors 230 and 240 provided in the lighting apparatus 200 according to this embodiment may have the same structure as the first and second connectors 130 and 140 according to the embodiment previously described above. Also, the light emitting device 250 may have the same structure as the light emitting device 150 described above, except the second terminal 320 further provided in this embodiment.

An accommodating recess may be provided in the back surface of the housing and an electric control device configured to electrically connect the LED light source with the second terminal may be arranged in the accommodating recess. In this structure, the lighting apparatus 200 may be electrically connected using the first and second terminals 310 and 320, such that electrical connection is easily made when mounting the lighting apparatus 200 to the bracket 110. After that, an external electric power may be provided to the light emitting unit 250.

Figure 12:
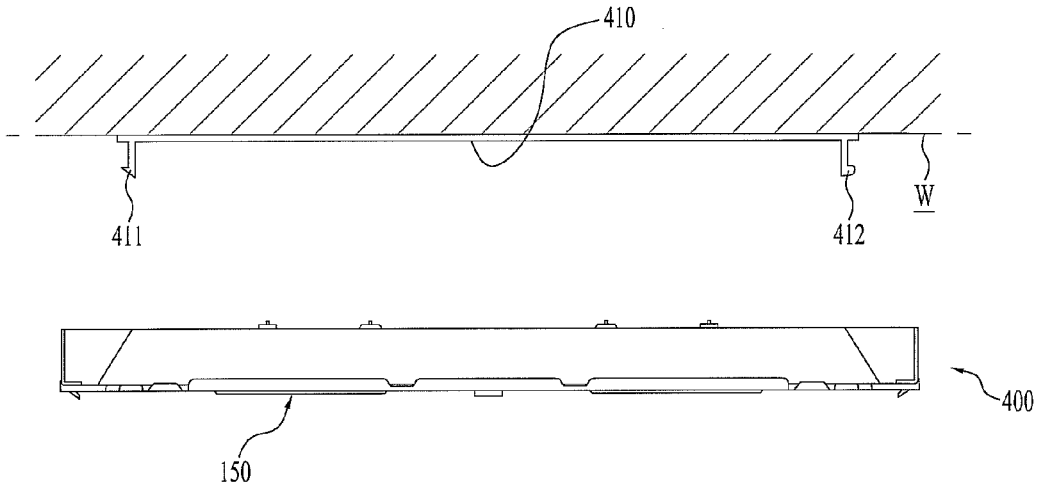
FIG. 12 is a side view of a lighting apparatus according to one embodiment of the disclosure as broadly described herein.
Figure 13:
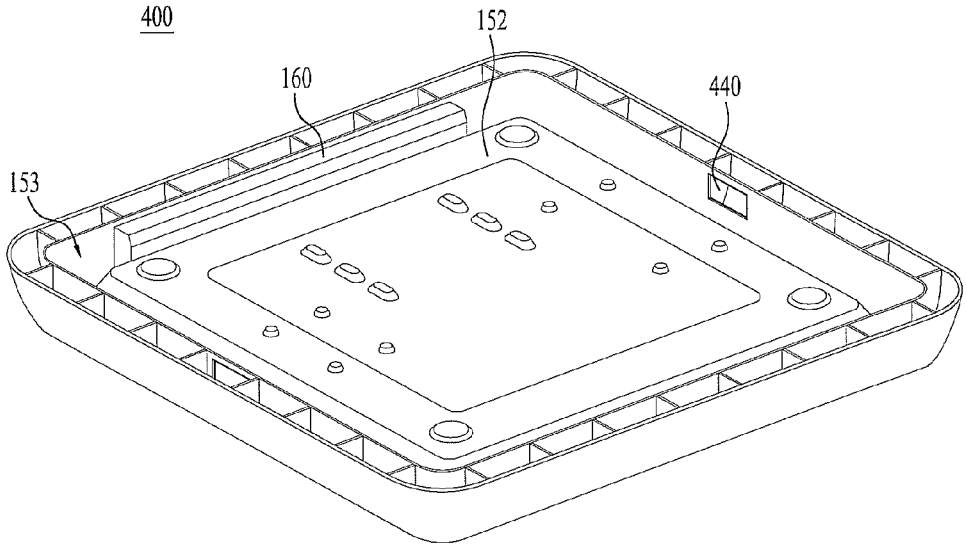
FIG. 13 is a perspective view of the lighting apparatus of FIG. 12.

FIG. 12 is a side view of a lighting apparatus according to one embodiment of the disclosure. FIG. 13 is a perspective view of the lighting apparatus of FIG. 12.

Referring to FIG. 12, the lighting apparatus 400 may include a bracket 410 mounted to a wall or ceiling W for mounting the lighting apparatus. The bracket 410 may include a first hanging device 411 and a second hanging device 412. The first and second hanging devices 411, 412 may be hooks that protrude from the body of the bracket 410.

The hooks 411, 412 may be inserted into corresponding catch 430, 440 integrally formed on a surface of the housing 151, 152. As illustrated in FIG. 13, the catch 430, 440 may be a recess, a notch, or another appropriate structure for connecting to the hooks 411, 412. The catch 430, 440 may be formed on a surface of the housing 151, 152. The hooks 411, 412 may be coupled to the catch 430, 440 by friction fitting. Here, the hooks 411, 412 and/or the housing 151, 152 where the catch 430, 440 is formed may be formed of a flexible material so as to allow the hooks 411, 412 to slide into and out of the catch 430, 440.

The hook 411 may have a sharp edge and hook 412 may have a rounded edge. It should be appreciated that both hooks 411 and 412 may have the same shape or different shapes. The rounded edges of hook 412 may allow the lighting apparatus 400 to be mounted or dismounted from the ceiling W with relative ease when compared to the sharp edges of hook 411.

In one embodiment, the catch 430, 440 may be formed on a separate bracket which is mounted to the housing 151, 152, rather than being formed directly on the surface of the housing. In this case, the bracket for the catch 430, 440 may be configured to be slidable such that hooks 411, 412 may be more easily released from the catch 430, 440 when uninstalling the lighting apparatus 400.

As broadly described and embodied herein, the lighting apparatus according to embodiments may easily be mounted to and demounted from a surface such as, for example a wall or ceiling, and may provide improved utilization of space. Furthermore, the lighting apparatus according to embodiments may be electrically connected conveniently at the same time the lighting apparatus is mounted or demounted to the bracket. Moreover, the lighting apparatus may have aesthetically pleasing appearance as various components such as, for example, mounting connectors may be hidden from view.

In one embodiment, a lighting apparatus may include a housing, a plurality of LEDs provided in the housing, a diffuser provided at the housing and positioned over the plurality of LEDs, a mounting bracket having a first hanger arranged to face a first direction and a second hanger arranged to face a second direction, and a first connector and a second connector provided at a rear surface of the housing and positioned to correspond to the first and second hangers of the mounting bracket, wherein the first and second connectors include a catch for mating with the first and second hangers, the catch of at least one of the first or second connectors being adjustable to mate with the first or second hanger.

The housing may include a recess formed at a rear region of housing, the recess having a prescribed shape that corresponds to a shape of the first or second connectors. The recess may extend along the rear surface and a side surface of the housing that is adjacent to the rear surface. A first outer surface of the connector may be substantially parallel to the rear surface of the housing and a second outer surface of the connector may be substantially parallel to the side surface of the housing. Moreover, the second outer surface of the connector may be substantially coplanar to the side surface of the housing.

At least one of the first or second connectors may include a first body having a first prescribed shape and a second body having a second prescribed shape that corresponds to the first prescribed shape to be slidably attached to the first body, and wherein the catch is formed on the second body.

The first body may be fixed to the rear surface of the housing and the second body may be configured to slide in the first and second directions. The at least one of the first or second connectors may include a spring attached between the first body and the second body to apply spring tension to the second body.

The catch may include a through-hole formed on a surface of the second body. The second body of the first connector may be configured to slide in the second direction for receiving the first hanger in the through-hole, and the spring may be configured to return the second body in the first direction for mating the catch with the first hanger.

A locking device may be provided to prevent movement of the second body. The locking device may be moveably coupled to the housing such that the locking device makes contact with the second body to lock the first connector. Moreover, a guide slot may be provided on the second body and a guide projection may be provided on the first body and formed to protrude into the guide slot. The guide slot may guide the sliding movement of the second body through the guide projection. Moreover, the first and second connectors may be configured to side toward each other.

The first and second connectors may be integrally formed on the housing. The first and second connectors may be recesses formed on a surface of the housing and the first and second hangers may be hooks configured to mate with a corresponding one of the recesses. The housing or the first and second hangers may be formed of a flexible material for friction fitting the first and second hooks in the first and second recesses. Moreover, a recess may be provided at the rear surface of the housing, and an electric control device may be positioned in the recess and electrically connected to the plurality of LED.

In one embodiment, a lighting apparatus may include a housing, a light emitting device provided in the housing and having a first electrical connector provided at a rear surface of the housing, a bracket having a first hanger arranged to face a first direction, a second hanger arranged to face a second direction opposite the first direction, and a second electrical terminal to connect to the first electrical terminal, the first hanger being positioned a first prescribed distance from the second hanger, a connector assembly that includes a first connector and a second connector provided at the rear surface of the housing, the first connector positioned a second prescribed distance from the second connector, the second prescribed distance being different than the first prescribed distance, wherein at least one of the first or second connectors are adjustable such that the first and second distances are the same.

In one embodiment, a lighting apparatus may include a housing, a plurality of LEDs provided in the housing, a diffuser provided at the housing and positioned over the plurality of LEDs, a mounting bracket having a first hanger arranged to face a first direction and a second hanger arranged to face a second direction, and a first connector and a second connector provided at a rear surface of the housing and positioned to correspond to the first and second hangers of the mounting bracket, wherein at least one of the first or second connectors include a base fixed to the housing and a catch slidably attached to the base such that a distance between the first and second connectors is adjustable for mating the first and second hangers to the catch of the first and second connectors.

In one embodiment, a lighting apparatus may include a bracket comprising first and second hangers spaced apart a predetermined distance from each other; a coupling module comprising first and second connectors to selectively couple the first and second hangers thereto, respectively; a light emitting device comprising a housing having a light emitting surface and a back surface to couple the coupling module thereto, and LEDs arranged in the housing.

The coupling module may adjust a distance between the first and second connectors based on the distance between the first and second hangers. The first connector may be movable toward the second connector. The first connector may include a guide member fixed to the housing; a sliding member slidably coupled to the guide member, with a through-hole formed therein to insert the first hanger therein; and an spring configured to connect the guide member with the sliding member.

The first hanger may be inserted in the through-hole, when the sliding member may be sliding toward the second connector from an initial position, and the first hanger may be coupled to the connector, when the sliding member may be restituted to an initial position. Moreover, the spring may have a tensile force to restitute the sliding member to the initial position.

The lighting apparatus may further include a locking member to maintain the initial position of the sliding member. The locking member may be in contact with the sliding member at a first position to prevent the sliding member from sliding toward the second connector and the locking member is separated from the sliding member at a second position. The locking member may be movably coupled to the housing to the second position and the first position.

A guide projection projected toward the sliding member may be provided in the guide member, and a guide slot configured to guide sliding movement of the guide projection may be provided in the sliding member.

A first coupling projection configured to couple a longitudinal end of the spring thereto and an opening configured to pass a predetermined portion of the spring there through may be provided in the guide member, and a second coupling projection configured to couple the other longitudinal end of the spring thereto may be provided in an inner circumferential surface of the through-hole provided in the sliding member.

An accommodating recess may be provided in the back surface of the housing, and an electric control part electrically connected with the LED light source may be positioned in the accommodating recess.

The first connector may be movable toward the second connector, and the second connector may be movable toward the first connector. Each of the connectors may include a guide member fixed to the housing; a sliding member slidably coupled to the guide member, with a through-hole formed therein to insert a corresponding hanger therein; and an spring configured to connect the guide member and the sliding member with each other.

The corresponding hanger may be inserted in the through-hole formed in each sliding member when the sliding member is sliding toward the other connector from an initial position, and the corresponding hanger may be coupled to the corresponding connector when the sliding member is restituted to the initial position.

The lighting apparatus further include a locking member configured to maintain the initial position of the sliding member. A guide projection projected toward the sliding member may be provided in the guide member, and a guide slot configured to guide sliding movement of the guide projection may be provided in the sliding member.

A first coupling projection configured to couple a longitudinal end of the spring thereto and an opening configured to pass a predetermined portion of the spring there through may be provided in the guide member, and a second coupling projection configured to couple the other longitudinal end of the spring thereto may be provided in an inner circumferential surface of the through-hole provided in the sliding member.

In one embodiment, a lighting apparatus may include a bracket comprising a first terminal connected with an external power source and first and second hangers spaced apart a predetermined distance from each other; a coupling module comprising first and second connectors to selectively couple the hangers thereto, respectively; and a light emitting unit comprising a housing to couple the coupling module thereto, with a light emitting surface and a back surface, an LED light source arranged in the housing and a second terminal connected with the first terminal. The coupling module may adjust a distance between the first and second connectors according to the distance between the first and second hangers.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting apparatus comprising:

a housing;

a plurality of LEDs provided in the housing;

a diffuser provided at the housing and positioned over the plurality of LEDs;

a mounting bracket having a first hanger arranged to face a first direction and a second hanger arranged to face a second direction; and a first connector and a second connector provided at a rear surface of the housing and positioned to correspond to the first and second hangers of the mounting bracket, wherein the first and second connectors include a catch for mating with the first and second hangers, the catch of at least one of the first or second connectors being adjustable to mate with the first or second hanger, and wherein at least one of the first or second connectors include a first body having a first prescribed shape and a second body having a second prescribed shape that corresponds to the first prescribed shape to be slidably attached to the first body, and wherein the catch is formed on the second body.

2. The lighting apparatus of claim 1, wherein the housing includes a recess formed at a rear region of housing, the recess having a prescribed shape that corresponds to a shape of the first or second connectors.

3. The lighting apparatus of claim 2, wherein the recess extends along the rear surface and a side surface of the housing that is adjacent to the rear surface.

4. The lighting apparatus of claim 3, wherein a first outer surface of the connector is substantially parallel to the rear surface of the housing and a second outer surface of the connector is substantially parallel to the side surface of the housing.

5. The lighting apparatus of claim 4, wherein the second outer surface of the connector is substantially coplanar to the side surface of the housing.

6. The lighting apparatus of claim 1, wherein the first body is fixed to the rear surface of the housing and the second body is configured to slide in the first and second directions.

7. The lighting apparatus of claim 6, wherein the at least one of the first or second connectors include a spring attached between the first body and the second body to apply spring tension to the second body.

8. The lighting apparatus of claim 1, wherein the catch includes a through-hole formed on a surface of the second body.

9. The lighting apparatus of claim 8, wherein the second body of the first connector is configured to slide in the second direction for receiving the first hanger in the through-hole, and the spring is configured to return the second body in the first direction for mating the catch with the first hanger.

10. The lighting apparatus of claim 1, further including a locking device to prevent movement of the second body.

11. The lighting apparatus of claim 1, wherein the locking device is moveably coupled to the housing such that the locking device makes contact with the second body to lock the first connector.

12. The lighting apparatus of claim 1, wherein a guide slot is provided on the second body and a guide projection is provided on the first body and formed to protrude into the guide slot, the guide slot guiding the sliding movement of the second body through the guide projection.

13. The lighting apparatus of claim 1, wherein the first and second connectors are configured to side toward each other.

14. The lighting apparatus of claim 1, wherein the first and second connectors are integrally formed on the housing.

15. The lighting apparatus of claim 14, wherein the first and second connectors are recesses formed on a surface of the housing and the first and second hangers are hooks configured to mate with a corresponding one of the recesses.

16. The lighting apparatus of claim 15, wherein the housing or the first and second hangers are formed of a flexible material for friction fitting the first and second hooks in the first and second recesses.

17. The lighting apparatus of claim 1, wherein a recess is provided at the rear surface of the housing, and an electric control device is positioned in the recess and electrically connected to the plurality of LED.

18. A lighting apparatus comprising:

a housing;

a light emitting device provided in the housing and having a first electrical terminal provided at a rear surface of the housing;

a bracket having a first hanger arranged to face a first direction, a second hanger arranged to face a second direction opposite the first direction, and a second electrical terminal to connect to the first electrical terminal, the first hanger being positioned a first prescribed distance from the second hanger;

a connector assembly that includes a first connector and a second connector provided at the rear surface of the housing, the first connector positioned a second prescribed distance from the second connector, the second prescribed distance being different than the first prescribed distance, wherein the first and second connectors include a catch for mating with the first and second hangers. and at least one of the first or second connectors are adjustable such that the first and second distances are the same, and wherein at least one of the first or second connectors include a first body having a first prescribed shape and a second body having a second prescribed shape that corresponds to the first prescribed shape to be slidably attached to the first body, and wherein the catch is formed on the second body.

19. A lighting apparatus comprising:

a housing;

a plurality of LEDs provided in the housing;

a diffuser provided at the housing and positioned over the plurality of LEDs;

a mounting bracket having a first hanger arranged to face a first direction and a second hanger arranged to face a second direction; and a first connector and a second connector provided at a rear surface of the housing and positioned to correspond to the first and second hangers of the mounting bracket, wherein at least one of the first or second connectors include a base fixed to the housing and a catch slidably attached to the base such that a distance between the first and second connectors is adjustable for mating the first and second hangers to the catch of the first and second connectors, and wherein at least one of the first or second connectors include a first body having a first prescribed shape and a second body having a second prescribed shape that corresponds to the first prescribed shape to be slidably attached to the first body. and wherein the catch is formed on the second body.

* * * * *